US008061133B2

(12) United States Patent
Loeffler

(10) Patent No.: US 8,061,133 B2
(45) Date of Patent: Nov. 22, 2011

(54) PISTON STEAM ENGINE WITH INTERNAL FLASH VAPORIZATION OF A WORK MEDIUM

(75) Inventor: Michael Loeffler, Jockgrim (DE)

(73) Assignee: Electricite de France (FR)

( * ) Notice: Subject to any disclaimer, the term of this patent is extended or adjusted under 35 U.S.C. 154(b) by 398 days.

(21) Appl. No.: 12/246,269

(22) Filed: Oct. 6, 2008

(65) Prior Publication Data

US 2009/0100832 A1 Apr. 23, 2009

Related U.S. Application Data

(63) Continuation of application No. PCT/EP2007/003052, filed on Apr. 4, 2007.

(30) Foreign Application Priority Data

Apr. 4, 2007 (DE) ..... 10 2006 015 754

(51) Int. Cl.
*F01B 29/00* (2006.01)

(52) U.S. Cl. ..... 60/512; 60/514; 60/515

(58) Field of Classification Search ..... 60/508–515
See application file for complete search history.

(56) References Cited

U.S. PATENT DOCUMENTS 3,720,188 A 3/1973 Mead
4,149,383 A * 4/1979 Spalding ..... 60/509
4,301,655 A 11/1981 Thomas
4,416,113 A * 11/1983 Portillo ..... 60/513
4,599,859 A * 7/1986 Urso ..... 60/514

FOREIGN PATENT DOCUMENTS

| | | |
|---|---|---|
| DE | 10000082 | 5/2001 |
| DE | 10062835 | 6/2002 |
| EP | 0787900 | 8/1997 |
| FR | 2258520 | 8/1975 |
| GB | 171291 | 11/1921 |
| GB | 2082683 | 3/1982 |
| JP | 6117256 | 4/1994 |

OTHER PUBLICATIONS

PCT/EP 2007/003052 International Search Report.

* cited by examiner

*Primary Examiner* — Hoang Nguyen
(74) *Attorney, Agent, or Firm* — Brinks Hofer Gilson & Lione

(57) ABSTRACT

The invention relates to a piston steam engine having flash vaporization. Said inventive piston steam engine can be operated with various working mediums and at different temperatures. The liquid working medium is successively injected into individual prechambers of the vapor machine cylinder. The inlet temperature of said working medium is adapted to the expansion step in the working cycle of the machine in relation to the respective point in time of injection.

14 Claims, 4 Drawing Sheets

PISTON STEAM ENGINE WITH INTERNAL FLASH VAPORIZATION OF A WORK MEDIUM

CROSS-REFERENCE TO RELATED APPLICATIONS

Figure 1:
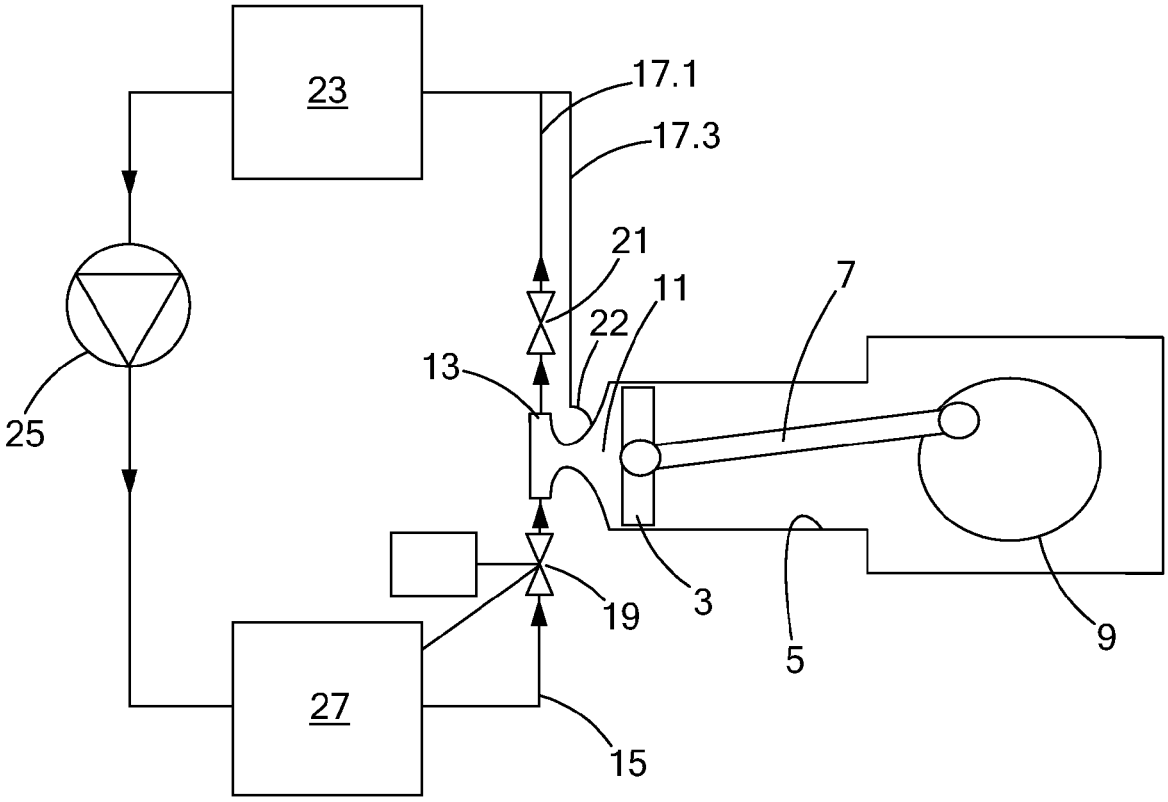

This application is a continuation of International Application No. PCT/EP2007/003052 filed on Apr. 4, 2007, which claims the benefit of DE 10 2006 015 754.0, filed Apr. 4, 2006. The disclosures of the above applications are incorporated herein by reference.

FIELD

Existing piston steam engines operate with steam that is produced by a steam generator. The steam is routed through inlet valves and exhaust valves in such a way that it passes at high pressure into the cylinder chamber, moves the piston within the cylinder chamber, when its pressure is released, after which it is forced out of the cylinder chamber by the piston.

BACKGROUND

The statements in this section merely provide background information related to the present disclosure and may not constitute prior art.

In most instances, the steam generators that are required for a piston steam engine consist of a heat transfer device within which the working medium, for example water, is vaporized at the desired operating pressure. The heat that is required for the vaporization process is generated by a thermal-transfer medium, for example smoke gases. Within the steam generator, the thermal transfer medium is cooled to a temperature within the range of the vaporization temperature of the working medium.

In another approach, the attempt is made to bring about so-called flash vaporization in a screw-type machine. Here, reference is made to the work of Professor Kauder of the University of Dortmund. The principle disadvantages of a screw-type machine are numerous.

In a screw-type machine, the compression or expansion ratios (subsequently referred to as the volume ratio) are between approximately 4 and a maximum of 8. In a piston steam engine, volume ratios of greater than 100 can be achieved.

The convective heat exchange that takes place between the working medium and the walls of the screw-type machine is extremely large because there exists a fully formed two-phase flow, besides which the heat-transferring surface is very large.

By virtue of its construction, the degree of efficiency of a screw-type machine is relatively low, and the leakage losses cannot be reduced by seals or piston rings, as is the case with piston steam engines.

In the case of other known combustion engines that are on the market, for example conventional piston steam engines, ORC engines that operate according to the organic Rankine cycle, Rankine engines, or steam turbines, only a relatively low mechanical performance can be achieved from them, particularly if the heat source is at a relatively low temperature, for example 200° C.

In order to make the best possible use of the energy contained in the heat of the working medium, the heat-transfer medium of the heat source should be cooled to ambient temperature in a process that is as reversible as possible.

In general, however, in the steam generators of known combustion engines, the thermal transfer of the heat source is cooled only to a temperature that is close to the vaporization or condensation temperature. For example, the thermal transfer medium is cooled only from 200° C. to 140° C. and not to ambient temperature. In particular, if only heat at a relatively low temperature level is available, and only a small amount of it is convertible into mechanical energy, then this relatively high end temperature of the thermal transfer medium of the heat source and the associated low exergonic efficiency has a particularly deleterious effect on the performance and the economics of the combustion engine.

In addition, partially toxic or injurious working media are used in many of the combustion engines referred to above.

SUMMARY

It is the objective of the present invention to describe a combustion engine that eliminates, at least in part, the above described disadvantages that are found in combustion engines that are found in the prior art. In addition, using the combustion engine according to the present invention, the greatest possible proportion of the available heat is converted into mechanical work.

According to the present invention, this objective is achieved with a piston steam engine as defined in the preamble to patent claim 1, in that the working medium is introduced at least indirectly into the working chamber of the piston steam engine in liquid form when the piston is at top dead centre, too. This means that it is possible that in the piston steam engine according to the present invention the liquid phase and the vapor phase of the working medium are separated, so that the liquid phase comes into contact with the walls of the piston steam engine to a very slight extent. In a test model, for example, only 2% of the surface of the working chamber was wetted by the liquid phase of the working medium. This greatly reduces thermal losses.

In the piston steam engine according to the present invention, hot working medium that is under pressure is introduced directly or indirectly into the working chamber in liquid form. Because of the pressures and temperatures within the piston steam engine, the working medium begins to vaporize as soon as it is introduced into the piston steam engine. The resulting vapor pressure drives the piston.

As the piston moves, the volume of the cylinder also increases and more of the working medium can vaporize. The liquid fraction of the working medium cools during vaporization. As the pressure decreases, the vapor fraction of the working medium also cools. Because of these processes, the efficiency-especially the exergonic efficiency and the power of the piston steam engine according to the present invention increases greatly as compared to other combustion engines.

In one advantageous version of the present invention there is at least one prechamber that is connected to the working chamber; it is preferred that the working medium be introduced into the prechamber and more preferably by way of a circular path. The circular path of the liquid phase generates centrifugal forces that accelerate the liquid phase forcefully radially outward because of its high density. The vapor that results during the flash vaporization of the working medium is considerably less dense than the liquid phase and can flow into the cylinder chamber since the connection between the prechamber and the working chamber opens out into the centre of the working chamber. The radial acceleration means that the liquid phase cannot escape from the prechamber. This forms a very simple and at the same time effective phase separation. The volume of the prechamber should be as small as possible.

In another version of the present invention, there is a plurality of prechambers and/or a plurality of injectors for each cylinder, and each of these is connected to the working chamber. Thus, it is possible to introduce the working medium into the prechambers and/or into the working chamber at different temperatures, depending on the pressure prevailing within the working chamber during the power stroke, and/or the prevailing temperature within the working chamber one after the other, and/or position of the piston, Thus working medium at different temperatures can be coupled into the piston steam engine according to the present invention without exergonic losses because of the mixing processes.

If a plurality of injector valves inject into a prechamber or the working chamber one after another, it must be ensured that the working medium that is already within the cyclone is not vaporized or sprayed by the injection process.

Alternatively, it is also possible to introduce the working medium directly into the working chamber either completely or partially. When this is done, the liquid working medium can be vaporized during the injection process and be divided between the working chamber and, if there is one, the prechamber, in the form of small droplets. Direct contact between the droplets and the surfaces of the piston steam engine is avoided because of the friction between the droplets and the gaseous phase of the working medium. As a result, the undesirable transfer of heat between the droplets and the surfaces of the piston steam engine is also greatly reduced.

The injectors that are used can be the same as those that are used in the fuel injection systems of conventional Otto or Diesel engines. These commercially available injectors will, of course, have to be adapted to the special working conditions, in particular the very high temperatures and corrosive working media.

If the heat transfer medium is at a temperature of approximately 200 degrees C. to 359 degrees C., water has been found to be particularly suitable.

If the heat or waste heat is at a temperature of approximately 150 degrees C. to 200 degrees C., methanol has been found to be particularly suitable.

If the heat or waste heat is at a temperature of approximately 100 degrees C. to 150 degrees C., pentane has been found to be particularly suitable.

If the heat or waste heat is at a temperature of approximately 100 degrees C., R134a has been found to be particularly suitable.

For the remainder, it has been found to be advantageous to provide internal and/or external thermal insulation on those surfaces of the piston steam engine that come into contact with the liquid working medium.

The internal thermal insulation is particularly important to prevent the liquid working medium that is cooling down picking up convective heat from the cyclone walls or other surfaces of the piston steam engine. This coating that is arranged on the working chamber or on the inside walls of the cyclone can be of Teflon, enamel, or ceramic.

As an alternative, or in addition, the surfaces of the piston steam engine that come into contact with the working medium can be heated in order to prevent the working medium condensing on these surfaces. If a gaseous phase is formed by the flash process, the parts of the machine that are accessible to the gaseous phase must be at a temperature that is greater than the condensation temperature of the working medium at that particular and prevailing gas pressure. Were these parts colder, part of the resulting gaseous phase would condense instantaneously on these surfaces and the condensed phase would no longer be available to power the machine and the machines power and efficiency would decrease.

Further areas of applicability will become apparent from the description provided herein. It should be understood that the description and specific examples are intended for purposes of illustration only and are not intended to limit the scope of the present disclosure.

DRAWINGS

Figure 2:
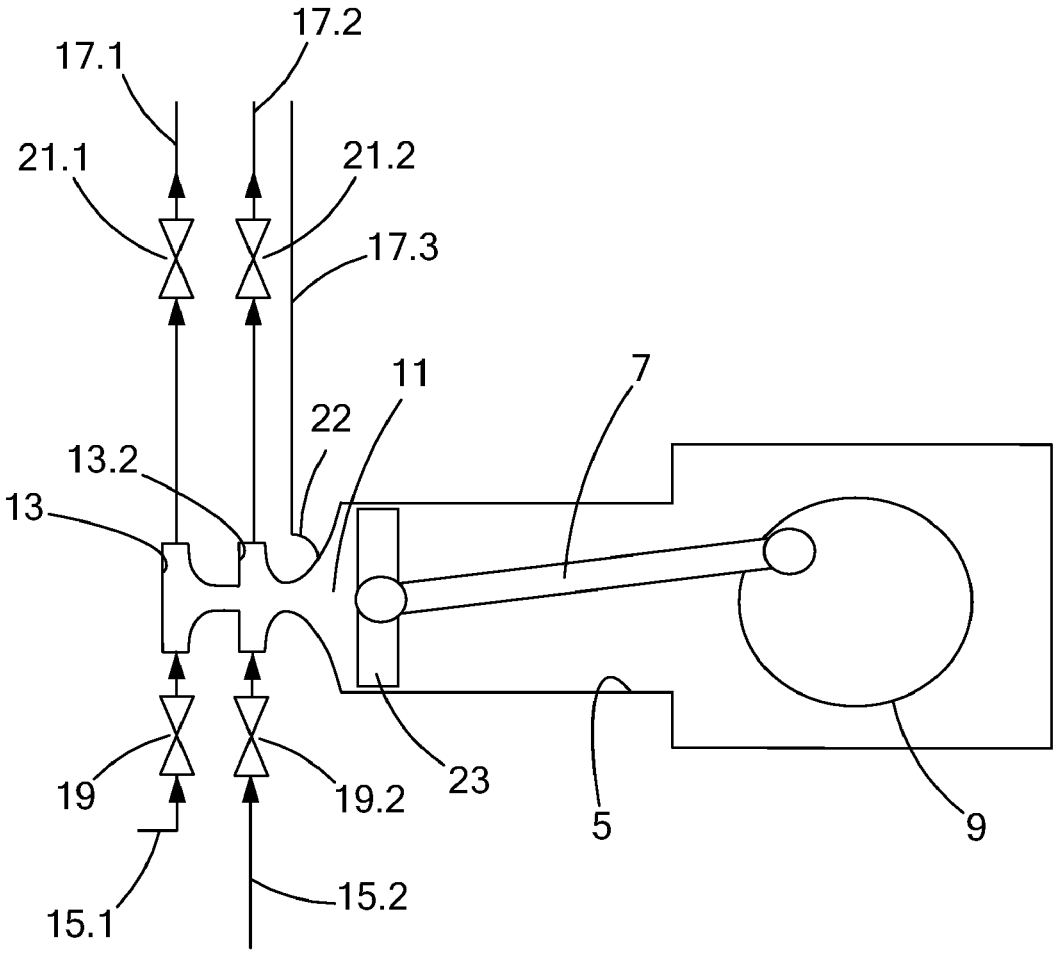
Figure 3A:
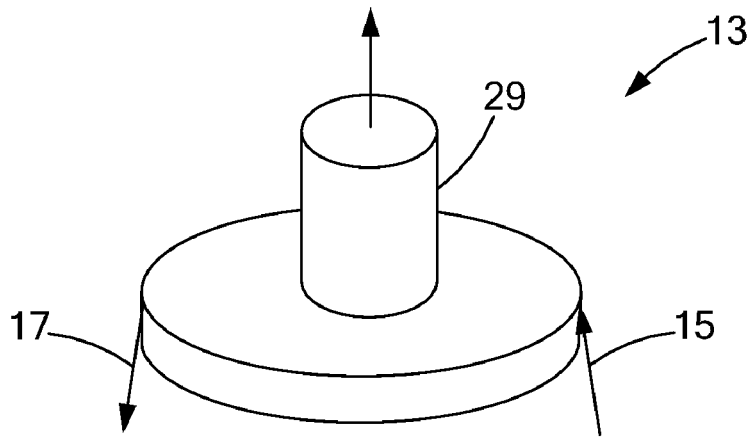
Figure 3B:
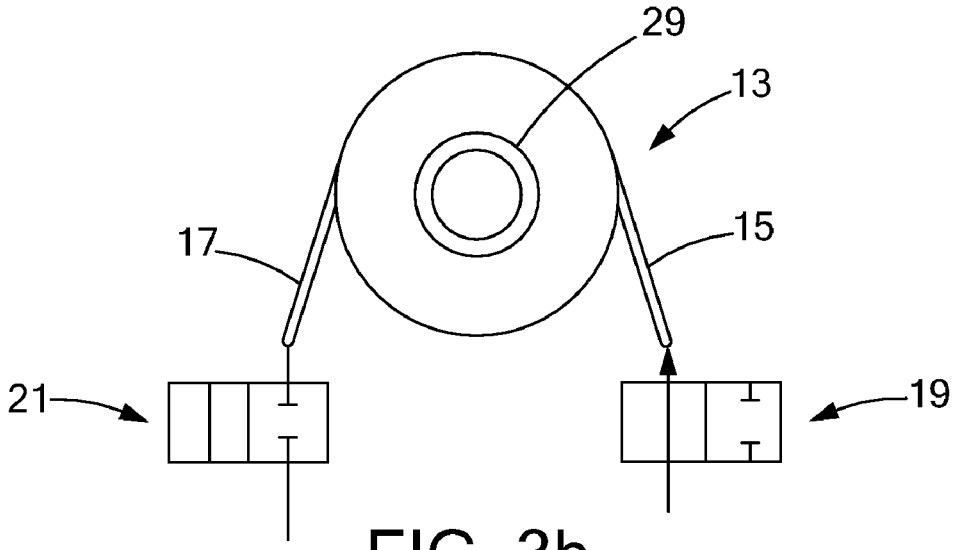
Figure 3C:
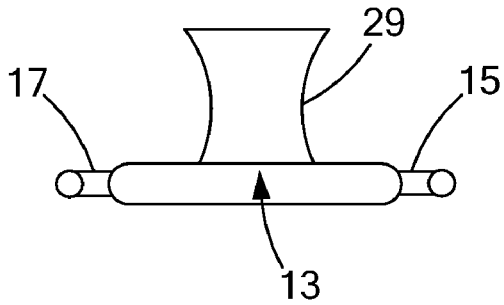
Figure 4:
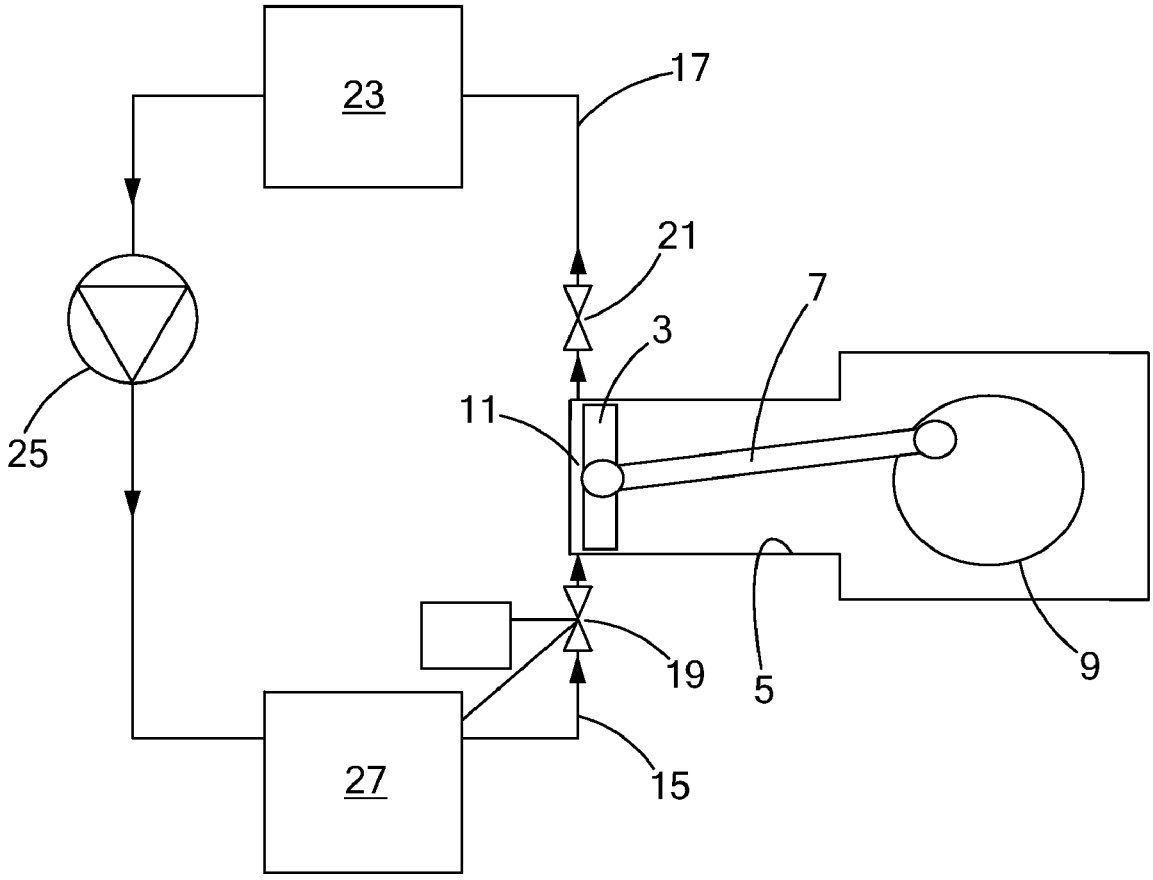

In order that the disclosure may be well understood, there will now be described various forms thereof, given by way of example, reference being made to the accompanying drawings, in which:

FIGS. 1 & 2: Embodiments of a piston steam engine according to the present invention, with a cyclone;

FIG. 3: A prechamber of a piston steam engine according to the present invention;

FIG. 4: An embodiment of a piston steam engine according to the present invention, with an injector that sprays into the working chamber.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

FIG. 1 shows an example of the construction of a first embodiment of a piston steam engine according to the present invention, with a prechamber 13, a piston 3, a cylinder 5, a connecting rod 7, and a crankshaft 9, which can be connected to a generator (not shown herein).

The piston 3 and the cylinder 5 define a working chamber 11. A prechamber 13 is connected to the working chamber 11. A feed line 15 and a drain line 17 for the working medium open out into the prechamber 13. The drain line 17 for the working medium can also open out directly into the working chamber 11.

A switchable inlet valve 19 for the liquid working medium is arranged in the feed line 15. With the help of this inlet valve (which can be configured as an injector) it is possible to spray liquid working medium into the prechamber 13. It is preferred that this spraying take place when the piston 3 is at or close to TDC.

Since, at the time of injection, the pressure within the prechamber 13 is lower than the pressure of the working medium in the feed line 15, immediately after the injection of the working medium, so-called flash vaporization takes place within the prechamber 13 and in the working chamber 11 connected with the prechamber 13. As a result of this, the pressure within the prechamber 13 rises so that the piston 3 is moved towards bottom dead centre, thereby imparting work to the crankshaft 9.

When the piston 3 is in the area of BDC, a switchable outlet valve that is incorporated in the drain line 17 for the working medium is opened and during its next movement the piston moves the towards TDC and moves the remaining liquid phase and the working medium that has become vapor in the direction of top dead centre and out of the working chamber.

Among other things, the drain line 17 removes the liquid phase that is remaining in the prechamber 13. The working medium that has become vapor can also be removed through the drain line 17. As an alternative, it is also possible to incorporate an additional vapor valve 22 within the working chamber 11 and the working medium that has become vapor drains off through this. The vapor valve 22 can be a poppet valve and configured and operated by a cam shaft (not shown herein) in the same way as a gas-exchange valve in an internal combustion engine.

If the working medium in routed in a closed circuit, the drain line 17.1 for the working medium opens out into a condenser 23. The working medium that is drained off through the vapor valve 23 can be routed into the condenser 23 through a drain line 17.3, where the working medium is again liquefied and then passed to a heat exchanger 27 by a pump 25. From there, the working medium moves into the prechamber 13 by way of the feed line 15.

FIG. 2 shows the construction of a piston steam engine according to the present invention with two prechambers 13.1 and 13.2, two feed lines 15.1 and 15.2 for the working medium. Two switchable inlet valves 19.1 and 19.2 are arranged within the feed lines 15.1 and 15.2.

The remaining parts of the piston steam engine and its periphery can be the same as in the first embodiment as shown in FIG. 1, to which reference is made herein. The working medium within the first feed line 15.1 is at a higher temperature than the working medium within the second feed line 15.2. For thin reason, a specific quantity of the working medium within the first feed line 15.1 is first introduced into the first prechamber 13.1, where it vaporizes and imparts work to the piston 3. When this takes place, the temperature and the pressure of the working medium within the working chamber 11 and the prechambers 13.1 and 13.2 grow less. As soon as the temperature of the working medium within the working chamber 11 and the prechambers 13.1 and 13.2 approximates the temperature of the working medium within the second feed line 15.2, working medium from the second feed line 15.2 is introduced into the second prechamber 13.2 through the briefly opened second inlet valve 19.2, in the same stroke of the piston 3. Once introduced into the prechamber 15.2, this working medium also vaporizes immediately and imparts work to the piston 3.

Using this embodiment of the piston steam engine according to the present invention it is possible to utilize heat that is at two levels. As a result, for example, in an internal combustion engine the waste heat can be used in an optimal manner since in an internal combustion engine the exhaust gases are at a temperature of greater than 200° C., whereas the cooling agent ant the oil are at a temperature of 120° C. In order to bring the working medium to two different temperatures it is necessary to have a first heat exchanger (not shown herein) that operates on the waste heat of the exhaust gases, and a second heat exchanger (not shown herein) that is heated with the waste heat of the cooling water and of the oil.

First, the hotter working medium is injected at a temperature of 200° C. Once this has cooled to 120° C., working medium at approximately 120° C. is injected. The efficiency of an internal combustion engine, which is related to combustion heat, can be increased by approximately 10% with such a piston steam engine.

The piston steam engine according to the present invention is a two-cycle engine that has neither an induction nor a compression stroke. The inlet valve(s) 21 are closed when the piston 3 is within the area of TDC, and the working medium is injected through the inlet valve 19. As the piston 3 moves from TDC to BDC, part of the working medium vaporizes, as has been described. The outlet valve 21 opens in the area of BDC. As the piston 3 moves from BDC to TDC, the remaining liquid phase and the gaseous phase that has formed are expelled through the outlet valve 21. The liquid and the gaseous phase can pass through the same outlet valve 21, or separate valves can be provided Hot, liquid working medium is injected under pressure into a prechamber of the piston steam engine according to the present invention. The working medium can be harmless water.

FIG. 3 shows the construction of a prechamber 13 for a piston steam engine according to the present invention. The prechamber 13 is constructed in the same way as a cyclone separator. The drawing shows the feed line 15, the drain line 17, and the valves 19 and 21.

The liquid working medium is essentially introduced tangentially into the prechamber 13 and follows a circular path that lies radially to the outside. Because of its low density, the vapor that results from the flash vaporization is forced to the middle of the prechamber 13 so that separation of the liquid and the gaseous working medium takes place within the working chamber 11. A connection 29 that opens out into the working chamber 11 is arranged in the middle of the prechamber 13, and the gaseous working medium moves from the prechamber into the working chamber 11 by way of this connection.

If the prechamber 13 is located below the connection 29 and below the working chamber 11 (not shown in FIG. 3), gravity will also assist in the separation of the liquid and the gaseous phases.

It order that the resulting vapor does not condense on surfaces within the working chamber, the particular surfaces of the piston 3, cylinder 5, and prechamber 13 must be heated and/or thermally insulated. Two additional steps can be taken in order to ensure that no heat is transferred from the heated surfaces to the liquid phase of the working medium.

Geometrically, the prechamber 13 is formed in such a way that the liquid phase of the working medium that is injected can move in a stable fashion on a circular path. In this case, the prechamber 13 is designated as a cyclone. The centrifugal forces that are generated along the circular path ensure that the resulting vapor—on which smaller centrifugal forces act because of lesser density—can escape into the cylinder space of the piston steam engine and the liquid heat-carrier medium—on which greater centrifugal forces act because of greater density—remain in the circuit. Tests have shown that phase separation can be achieved in this way during the vaporization process.

Calculations have shown that despite the friction of the liquid on the walls of the prechamber 13, the rotational speed of the liquid working medium remains at a level that is sufficient for phase separation to take place, and that the thermal exchange of the liquid working medium with the walls of the cyclone does not lead to any noteworthy impairment of the process, given suitable dimensioning of the machine and coating of the prechamber walls.

Tests have also shown that phase separation is successful: the liquid phase remains in the cyclone during phase separation, whereas the gaseous phase escapes into the cylinder chamber.

In addition, it could be shown that the convection of the liquid phase with the wall of the prechamber 13 is not considerable. In the test, after the flash process, essentially the calculated quantity of liquid phase is present. Convection did not lead to an essential additional vaporization.

Finally, tests also showed that the flash process takes place at very high speed in the prechamber 13 and the working chamber 11, which is important for the performance of the machine.

FIG. 4 shows an additional embodiment of a piston steam engine according to the present invention. This embodiment has no prechamber 13 and the liquid working medium in injected directly into the working chamber 11. This can be done with the help of an injector known in the prior art.

During the injection process, the working medium is reduced to small droplets in much the same way as when diesel fuel is injected into the combustion chamber of in internal combustion engine. The droplets are kept is suspension because of friction in the gas phase. In this way, the droplets can come into contact with the hot surfaces only to a slight extent and thermal exchange between the liquid phase and the hot surfaces is kept at a low level and thermal exchange between liquid phase and the hot surface is kept low. With a piston steam engine according to the present invention, given an available heat source it is possible to obtain approximately double the mechanical efficiency as compared to current machines that are based on an ORC or a Kalina process. In addition, a non-hazardous working medium, for example water, is used.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A piston steam engine with at least one cylinder, a piston oscillating within the at least one cylinder, with a working chamber, said working chamber being defined by the cylinder and the piston, with at least one inlet valve, a working medium being routable into the working chamber through the at least one inlet valve, with at least one outlet valve, the working medium being routable out of the working chamber through the at least one outlet valve, characterized in that when the piston is in the area of top dead center (TDC) or during the power stroke, at least one prechamber being provided, the working chamber and the prechamber connected to each other, the working medium being in liquid form when introduced in the prechamber and separated into a liquid phase and a vapor phase in the prechamber, wherein the vapor phase of the working medium flows into the working chamber.

2. The piston steam engine as defined in claim 1, characterized in that the working medium is introduced essentially tangentially into the prechamber.

3. The piston steam engine as defined in claim 1, characterized in that the connection between the working chamber and the prechamber opens out in the middle of the prechamber.

4. The piston steam engine defined in claim 1, characterized in that a plurality of prechambers is arranged for each cylinder; in that the prechambers are connected to the working chamber; and in that working medium at different temperatures is introduced into the prechambers or into the working chamber depending on the prevailing pressure within the working chamber or the prevailing temperature within the working chamber.

5. The piston steam engine as defined in claim 1, characterized in that a plurality of inlet valves is provided for each cylinder.

6. The piston steam engine an defined in claim 1, characterized in that the liquid working medium that is injected from the various inlet valves or injectors is at different temperatures; and in that the liquid working medium that is injected out of the various injectors is injected in sequence from the warmest to the coldest and the next working medium in turn is injected when the working medium that is already in the prechamber or the working chamber has reached the temperature of the next coldest working medium.

7. The piston steam engine as defined in claim 1, characterized in that the liquid working medium is injected into the working chamber or into the at least one prechamber with the help of an injector.

8. The piston steam engine as defined in claim 1, characterized in that during the injection process, the liquid working medium is reduced to small droplets of liquid.

9. The piston steam engine as defined in claim 1, characterized in that water, methanol, pentane, and/or R134a is used as the working medium.

10. The piston steam engine as defined in claim 1, characterized in that at least one of the cylinder, the piston and the at least one prechamber are thermally insulated internally and externally.

11. The piston steam engine as defined in claim 10, characterized in that the interior thermal insulation includes at least one of Teflon, enamel, and ceramic.

12. The piston steam engine as defined in claim 1, characterized in that the cylinder, the piston and/or the at least one prechamber can be heated.

13. The piston steam engine as defined in claim 1, characterized in that a vapor valve is provided; and in that the vaporized working medium can be expelled from the working chamber by means of the vapor valve.

14. The piston steam engine as defined in claim 1, characterized in that the at least one outlet valve(s) valve and the vapor valve are closed in the area of the TDC; in that liquid working medium is next introduced into the prechamber or into the working chamber; and in that the at least one outlet valve is opened in the area of bottom dead center (BDC).

* * * * *

UNITED STATES PATENT AND TRADEMARK OFFICE

CERTIFICATE OF CORRECTION

PATENT NO. : 8,061,133 B2
APPLICATION NO. : 12/246269
DATED : November 22, 2011
INVENTOR(S) : Michael Loeffler It is certified that error appears in the above-identified patent and that said Letters Patent is hereby corrected as shown below:

Title page, item (30) Foreign Application Priority Data should read as follows:

Apr. 4, [2007] 2006 (DE) . . . 10 2006 015 754

Signed and Sealed this
Twenty-seventh Day of November, 2012

David J. Kappos

David J. Kappos
*Director of the United States Patent and Trademark Office*